United States Patent [19]

Heyden

[11] Patent Number: 4,964,515

[45] Date of Patent: Oct. 23, 1990

[54] BAG CONSTRUCTION INCLUDING EASY-OPENING PROVISION

[76] Inventor: Eugene L. Heyden, S. 627 Bernard #8, Spokane, Wash. 99204

[21] Appl. No.: 424,054

[22] Filed: Oct. 19, 1989

Related U.S. Application Data

[63] Continuation-in-part of Ser. No. 353,211, May 16, 1989, abandoned, which is a continuation of Ser. No. 196,897, May 19, 1988, abandoned, which is a continuation of Ser. No. 41,464, Apr. 23, 1987, abandoned, which is a continuation-in-part of Ser. No. 10,189, Feb. 2, 1987, Pat. No. 4,795,270.

[51] Int. Cl.[5] ..... B65D 3/26

[52] U.S. Cl. ..... 206/632; 206/601; 206/815; 383/107

[58] Field of Search ..... 383/35, 77, 107, 114, 383/121; 206/610, 611, 604, 601, 620, 628, 629, 631–633, 815

[56] References Cited

U.S. PATENT DOCUMENTS

| | | | |
|---|---|---|---|
| 2,189,174 | 2/1940 | Hohl . | |
| 2,260,064 | 10/1941 | Stokes . | |
| 2,329,360 | 9/1943 | Salfisberg | 206/604 |
| 2,643,049 | 6/1953 | Bartelt . | |
| 2,676,702 | 4/1954 | Whitefoot, Jr. | 206/363 |
| 2,851,212 | 9/1958 | Parmer | 206/620 |
| 2,990,101 | 6/1961 | Mead et al. . | |
| 3,083,821 | 4/1963 | Woodson | 229/48 T |
| 3,189,253 | 6/1965 | Mojonnier . | |
| 3,220,610 | 11/1965 | Specheter | 206/603 |
| 3,233,821 | 2/1966 | Elilers . | |
| 3,419,137 | 12/1968 | Walek, III | 206/632 |
| 3,454,210 | 7/1969 | Spiegel et al. | 206/633 |
| 3,456,867 | 7/1969 | Repko . | |
| 3,458,111 | 7/1969 | Leasure et al. . | |
| 3,618,850 | 11/1971 | Palmer . | |
| 3,785,111 | 1/1974 | Pike . | |
| 4,279,344 | 7/1981 | Holloway, Jr. | 206/631 |
| 4,518,684 | 5/1985 | Martin | 206/633 |
| 4,549,657 | 10/1985 | Martin | 206/610 |
| 4,603,537 | 8/1986 | Pace | 53/415 |
| 4,609,107 | 9/1986 | Martin | 206/610 |

FOREIGN PATENT DOCUMENTS

| | | | |
|---|---|---|---|
| 0078761 | 5/1983 | European Pat. Off. . | |
| 2134295 | 3/1973 | Fed. Rep. of Germany | 206/364 |
| 2518929 | 11/1976 | Fed. Rep. of Germany | 206/603 |
| 2717128 | 11/1978 | Fed. Rep. of Germany | 206/610 |
| 1234664 | 6/1971 | United Kingdom | 206/363 |

*Primary Examiner*—Bryon P. Gehman

[57] ABSTRACT

A bag construction adapted for ease of opening. A tubular pocket, defined by the configuration of a separable top seal, allows the tip of a forefinger to position between opposing front and rear panels of the bag and to locate at the side of a commodity-confining compartment. So positioned, the forefinger may be moved toward a side of the bag in an action which will separate the top seal and effect a bag mouth for access to a confined commodity.

20 Claims, 4 Drawing Sheets

Fig. 6.
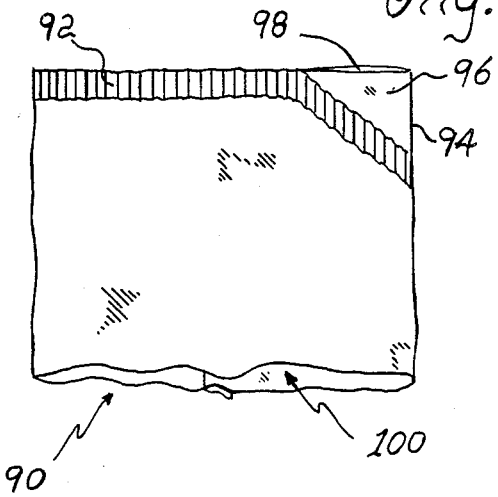
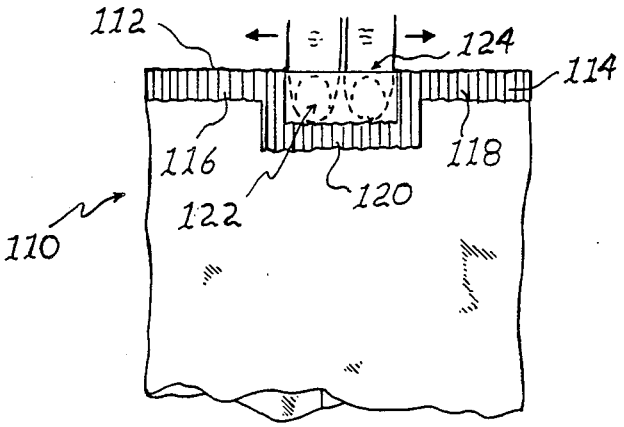
Fig. 7.

BAG CONSTRUCTION INCLUDING EASY-OPENING PROVISION

CROSS REFERENCE TO RELATED APPLICATIONS

This application is a continuation-in-part of Ser. No. 353,211, an earlier application of the same title, now abandoned and filed with the same title on May 16, 1989 as a continuation of Ser. No. 196,897. The Ser. No. 196,897 application, now abandoned, was filed May 19, 1988 as a continuation of an earlier application of the same title filed Apr. 23, 1987, Ser. No. 041,464 and now abandoned. The Apr. 23, 1987 application was filed as a continuation-in-part of Ser. No. 010,189, an original application filed on Feb. 2, 1987, now U.S. Pat. No. 4,795,270 and issued under the title RECLOSABLE BAG WITH A FOLDED PORTION ENGAGED BY A UNITARY MATERIAL SEPARATION ARRANGEMENT on Jan. 3, 1989.

BACKGROUND OF THE INVENTION

This invention relates to package containers such as heat-sealed plastic or foil-type bags, and more particularly to alternative sealing and structural arrangements provided for conveniencing their opening.

The common practice in the packaging of various commodities is to enclose the same within individual plastic bags, such as those made of polyethlene and the like, having opposing front and rear panels and opposing top and bottom seals which define a commodity-confining compartment. In bags of this class, the seals are conventionally formed by a combination of heat and pressure mechanically applied to appropriate locations on a continuously advancing web of sheet material previously formed into a generally tubular structure. In addition to top and bottom seals, a vertical midline seam is usually seen on the rear panel of the bag and is formed by heat-sealing overlapping side portions of the sheet material used in its construction. The top and bottom seals, which are often three-eighths to three-quarters of an inch in width, may be corrugated or pleated in appearance, while the midline seam is generally flat in character and may be folded against the rear panel of the bag.

Due to the inherent strength of the heat seals, the characteristics of the packaging material, and/or the structural formation of the bag itself, difficulty is often experienced when attempting to open such containers. This problem is well known and has been addressed in the past by the use of readily openable heat seals (U.S. Pat. No. 4,603,537 to Pace), tear strips (U.S. Pat. No. 2,613,049 to Bartelt), perforated lines (U.S. Pat. No. 3,189,253 to Mojonnier), and tab projections in various forms (U.S. Pat. No. 2,189,174 to Hohl and U.S. Pat. No. 3,036,756 to Lieschke), to mention a few of the easy-opening provisions available for plastic bags and the like. Because of inherent drawbacks in practicing these and other prior art methods or arrangements, often no special provision is made in the construction and sealing of bags to satisfactorily convenience their opening. The consumer is, therefore, often left with the difficult or inconvenient task of tearing or cutting the bag to gain access to its contents.

According to the intent thereof, it is a principle object of the present invention to provide an improved bag construction which allows for an ease-of-opening access to package contents.

It is another object of the present invention to provide an easy-opening provision for bags which is itself easy to accomplish according to current packaging methodology.

These and other objects will become apparent from a study of the summary and the detailed description of the invention in light of the attending drawing.

SUMMARY OF THE INVENTION

According the principle of the present invention, a generally tubular bag of flexible packaging material defines a commodity-confining compartment and is adapted for ease of opening by the provision of a pocket formation of substantial width defined by a separable top seal in its progression across the width of the bag. The pocket is opened to the exterior of the package at a top margin of the bag, is located near a side margin of the bag, and extends from said top margin to a location at the side of an upper portion of the commodity-confining compartment. The pocket, defined by unsealed portions of packaging material, is tubular in nature, and, having an adequate width for the purposes of the present invention, is receptive to the insertion of an elongated object whereby the inserted end of the elongated object is allowed to position at the side of the upper portion of the commodity-confining compartment. The preferred method of opening the bag utilizes a forefinger and comprises steps performed to progressively separate the top seal and to introduce the inserted end of the forefinger within the upper portion of the commodity-confining compartment. This is accomplished by inserting the forefinger maximally within the pocket, holding the bag at the side margin adjacent the pocket with a forefinger and thumb of the other hand, and moving the forefinger away from the pocket and associating side margin of the bag. Accordingly, the inserted forefinger will act to progressively separate the top seal and open the commodity-confining compartment for access to its contents.

BRIEF DESCRIPTION OF THE DRAWING

The invention can best be understood in conjunction with the accompanying drawing in which:

FIGS. 5, 6, and 7 demonstrate, in partial and front elevational views, other alternative embodiments of the present invention.

DETAILED DESCRIPTION OF THE INVENTION

Figure 1:
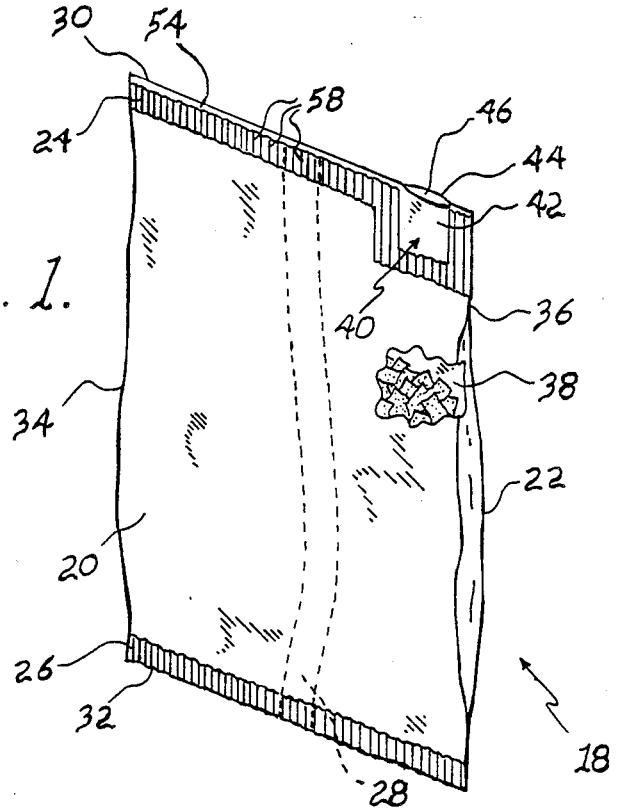
FIG. 1 is a perspective view of a bag construction representing the invention in the preferred embodiment, having a portion thereof partially broken away to reveal a commodity-confining compartment and a rear panel of the bag.
Figure 2:
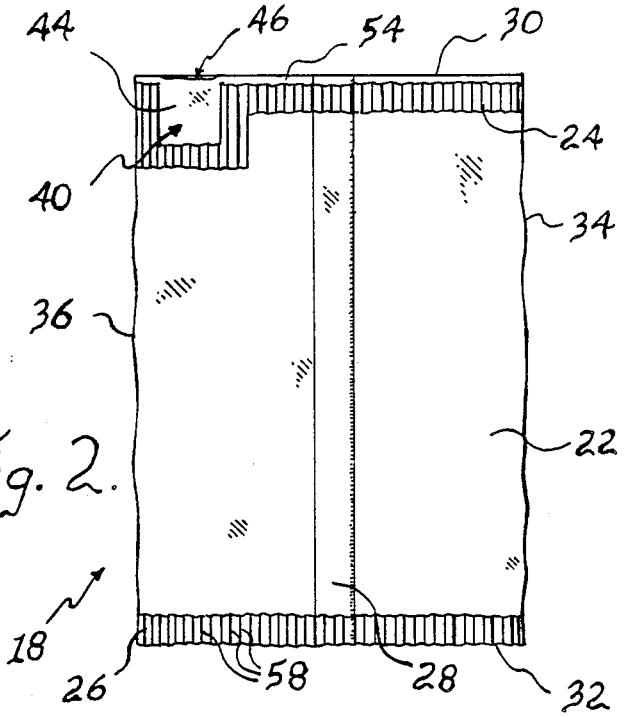
FIG. 2 is a rear elevational view showing the general features of the rear panel of the bag of FIG. 1.

Referring now in greater detail to the drawing, and with particular reference to FIGS. 1 and 2 which illustrate the invention in the preferred embodiment, the bag, referred to generally by reference numeral 18, comprises a package of a tubular character having a front panel 20 and an opposing rear panel 22, a top seal 24 associating with a top margin 30 or edge, a bottom seal 26 associating with a bottom margin 32 or edge, and opposing side margins 34 and 36. The side margins of the package define locations where the sides of the front and rear panels connect or meet with each other along the length of the package and also define the edges or sides of both the bag and the opposing panels. Also evident from the drawing is a midline seam 28 situated on the rear panel of the bag and extending the length of the bag. The midline seam is folded against the rear panel of the bag and defines a location where overlapping side portions of sheet material are sealingly joined to define a tubular structure from an advancing web of flexible packaging material. The midline seam is incorporated into the top and bottom seals, as shown in FIG. 2. The bag is thin-walled and flexible in character and may be constructed of polyethylene, polypropylene, or other heat-sealable materials or material laminations customarily used in the packaging industry, not to exclude future improvements on existing materials or materials heretofore unknown.

The top seal 24 and the bottom seal 26 contributively define a commodity-confining compartment 38 and comprise heat seals of uniform width and of satisfactory character to sealingly join transverse portions of opposing panels, per conventional practice. Also per conventional practice, the top and bottom seals are corrugated in nature, presenting an array of vertical heat-sealing lines 58, while the midline seam 28 is generally flat or non-corrigated in character, though of similar width. The sealing of the bag at its top and bottom flattens the structure at these locations, effectively altering the tubular appearance of the bag thereat. It has been found that heat seals of the corrugated or pleated type in polyethylene and polypropylene, for example, can be intentionally made to be separable if formed in a temperature range of 177 to 250 degrees Celsius. (See U.S. Pat. No. 4,603,537 to Pace.) The flat or non-corrugated type of transverse heat seals, which can alternatively be used, may also be made separable if formed within the same temperature range. With regard to the transverse seals, a separable seal characteristic is contemplated in the practice of the preferred embodiment and other embodiments of the present invention. Accordingly, FIG. 3 illustrates the opening of bag 18 by heat-seal separation.

Figure 3:
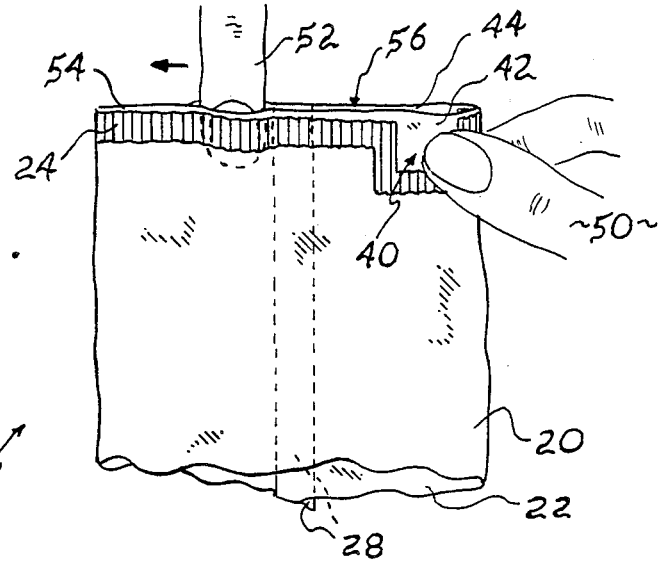
FIG. 3 is a partial and front elevational view of the bag of FIGS. 1 and 2 being opened.

Continuing with reference to FIGS. 1 and 2, and in view of FIG. 3, it can be seen that a pocket 40 is defined by the construction characteristics of the bag, particularly the configuration of the top seal, and is offset a predetermined distance from side margin 36 by a small portion of said top seal. The pocket is bordered by the top margin 30 of the bag and on three sides by a top seal 24 of predetermined width to define a closed perimeter portion of the pocket and to define; a generally square-shaped unsealed area of substantial width located between opposing portions of the front and rear panels of the bag. It can further been seen that the pocket extends to a pocket bottom a predetermined distance below a major portion of the top seal and has a substantial portion which resides between side margin 36 and the commodity-confining compartment. In defining the pocket and the closed perimeter portion thereof, the top seal, in effect, progresses from side margin 34 straight across a major portion of the width of the bag, progresses perpendicular away from the top edge and extends below said major portion to comprise a downwardly extending portion of the top seal, continues a short distance in parallel relation to the top margin of the bag to a pocket side of adjoining portions of the panels, and then progresses upward in opposed relation to the perpendicular extending portion of the top seal to regain a position adjacent top margin 30 to complete the closed perimeter portion and to complete the top seal's progression across the width of the bag. Pocket walls 42 and 44, which contributively define the pocket and represent substantially approximated, opposing portions of the flexible front and rear panels of the bag, are freely separable and, when separated, clearly demonstrate the tubular nature of the pocket. Accordingly, the pocket walls define what would be considered the interior of the pocket and are connected at their sides the length of the pocket. A pocket mouth 46 associating with the packaging material located at the top margin 30 of the bag allows the admission of an elongated object, such as a forefinger, within the interior of the pocket for initiating the opening of the bag. The pocket mouth may be formed during the manufacturing process by cutting the packaging material to effect the top margin of the bag and, at the same time, separate the bag from a trailing portion of the advancing web of packaging material yet to be formed into another individual bag. The cutting of the packaging material, and hence the accomplishment of a pocket mouth, may be performed simultaneously with, or subsequently to, the sealing of the top portion of the bag. The pocket mouth is shown in FIG. 1 in a partially open state for illustrative purposes; however, the pocket mouth may appear substantially closed in the ordinary practice of the invention due to the flattened character of the top portion of the bag.

Opening the bag as intended is illustrated in FIG. 3. To accomplish this task, the bag is grasped with the thumb and forefinger 50 of one hand at a location near the pocket and associating side margin of the bag, and the forefinger 52 of the other hand is maximally inserted within the pocket 40. Because the pocket extends a satisfactory distance below a major portion of the top seal 24, the tip of the forefinger can extend below said major portion to locate at the side of the upper portion of the commodity-confining compartment 38. Positioned in such matter, and due to the separable character of the seal itself, the tip of the forefinger will enter the upper portion of the commodity-confining compartment as the forefinger is moved in a direction away from the pocket and directly toward the other side of the bag. The performance of such a series of steps will progressively separate the portion of the top seal residing between the pocket and the commodity-confining compartment and will effect a bag mouth 56 for access to packaged contents.

Of special consideration in the practice of the present invention is the integrity of the midline seam 28. It is preferred and according to each of the disclosed embodiments herein that the midline seam be of a strongly-bonded type so as to resist unintentional separation as the tip of the forefinger passes this location of the bag during the opening procedure. It may also be desirable to fold the midline seam in the direction of the pocket, as shown in FIG. 2. A folding of the midline seam in this manner has been found to decrease the likelihood of seam separation during the opening of the package when the midline seam would otherwise exhibit a separable tendency.

An additional consideration in the practice of the invention in its preferred embodiment is an unsealed zone 54 located between the top margin 30 and the top seal 24 of the bag. It has been observed, in some instances, that the heat of sealing shoes may impart a significant degree of heat to closely associated cutting elements or members which serve to separate the bag from the web of packaging material. (The simultaneous sealing of the top of one bag, the bottom of what will become the next bag, and the separation of the bag from the remainder of the packaging material by various sealing shoe/cutting element combinations is well known and extensively practiced in the art.) If sufficient temperature is imparted to the cutting elements, the cutting elements themselves will act, in addition to the sealing shoes, as sealing elements and will thinly seal the opposing panels of the bag together at the location where the packaging material is cut. Such an occurrence may be considered undersirable, as it may create a thin seal above the pocket which would require separation before the insertion of an elongated object. Accordingly, the unsealed zone represents a spacing arrangement between sealing shoes and cutting elements which will prevent the sealing of the bag above the pocket. In such an arrangement, the pocket may be viewed as being offset somewhat from the top edge of the package with the unsealed zone allowing access to the pocket's interior.

Having thus disclosed the invention in the preferred embodiment, attention will now be directed to alternative embodiments. In each such embodiments, the general features and general characteristics of the bag are to be regarded as identical or substantially identical to the bag illustrated in FIGS. 1 and 2, and the pocket is to be regarded also as being generally tubular in nature as it defines an enclosed space or potential space of longitudinal extent completely surrounded on all sides by structure.

Figure 4:
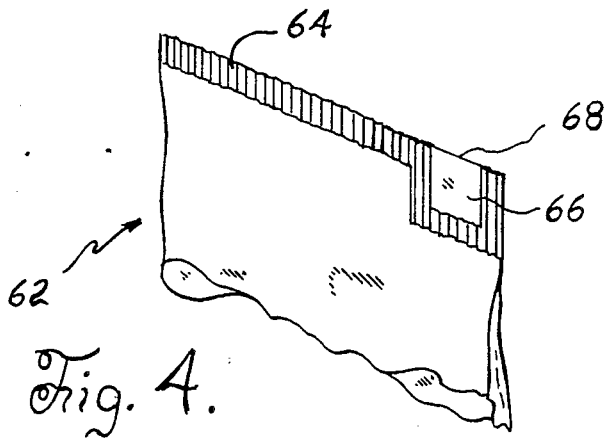
FIG. 4 demonstrates one alternative embodiment of the present invention, shown in part and in a perspective view.

FIG. 4 represents an embodiment of the invention similar to the embodiment of FIGS. 1 through 3, demonstrating a practice of the invention without the use of an unsealed zone. Associated with this embodiment is a thin pocket seal 68 located above the pocket 66, such as would occur from heat transferred to cutting elements as described above. The pocket seal, by reason of its thin nature and location, defines a pocket access means, and may be separated to create a pocket mouth (not shown) by pinching the pocket with the thumb and forefinger of one hand and sliding the pocket walls against each other in opposite directions. The opening of the bag 62 by separating the top seal 64 is accomplished as described in connection with FIG. 3.

Figure 5:
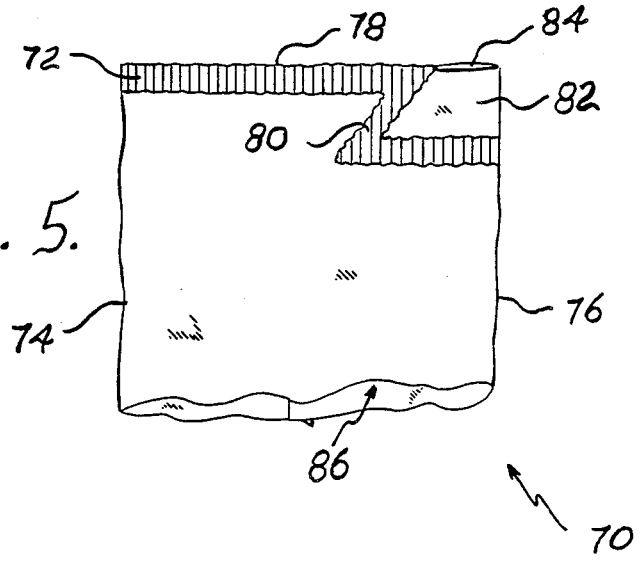

In FIG. 5, a top seal 72 of generally uniform width is Z-shaped in its progression across the width of the bag 70. Accordingly, the top seal progresses from side margin 74 toward side margin 76, continuing to a location where the top seal defines a segment 80 by non-perpendicularly progressing a substantial distance downwardly and away from top margin 78. The top seal maintains its uniform width as it progresses downward and to an extent whereby the pocket 82 has a substantial portion located both at the side of the commodity-confining compartment 86 and below the remaining portion of the top seal. Then, the top seal progresses toward side margin 76 in parallel relation to the top margin 78 of the bag to define the bottom of the pocket and ending at side margin 76, which together with the top seal completes the closed perimeter portion of the pocket, the top seal; maintaining the same uniform width as demonstrated by the remainder of the top seal. (Though not practiced with an upwardly extending portion of the top seal at side margin 76, as in FIGS. 1 through 3, a z-shaped top seal may further include such an upwardly extending portion intimately associated with side margin 76.) The bag may be opened in the manner illustrated in FIG. 3; however, in this embodiment the forefinger will meet with less resistance when initiating the opening of the top seal than will be experienced by meeting substantially an entire length of a vertically arranged portion of the top seal located between the pocket and the commodity-confining compartment as in the preferred embodiment. It can readily be appreciated that, as the top seal inclines away from the top margin 78 of the bag in the fashion illustrated in the figure, the forefinger will initially meet and separate a small, angular portion of the top seal nearest the top margin. The forefinger will then go on to progressively separate further angular portions of the segment 80 as it progresses toward side margin 74. Hence, the z-shape of the top seal is one option in the practice of the present invention which may by further ease the opening of the bag by the consumer. A pocket mouth 84 allows the entry of a forefinger or other elongated object into the tubular pocket defined by the z-shaped top seal.

In FIG. 6, the top seal 92 defines a pocket 96 of a triangular configuration by extending across the width of the bag 90 to a position near side margin 94 where it extends non-perpendicularly with respect to the top edge downward toward the side margin 94 to define a pocket having a major portion residing at the side of the commodity-confining compartment 100. A pocket mouth 98 resides above the pocket to admit a forefinger or other suitable object, as in the embodiment of FIGS. 1 through 3. Though triangular in configuration, the pocket is also distinctively tubular in nature, defining a closed perimeter portion of adjoined structure whereby an elongated object would be structurly confined when inserted therein. The bag may also be opened in the manner described in connection with FIG. 3.

In FIG. 7, the top seal 114 of the bag 110 defines a mid-positioned, rectangular pocket 122 extending from a top margin 112 a substantial distance below bilateral segments 116 and 118 of the top seal. A mid-positioned center portion 120 of the top seal is located below said bilateral segments and between the pocket and the commodity-confining compartment to define the bottom of the pocket. The bag may be opened by inserting one finger of each hand within the pocket through a pocket mouth 124, as illustrated, and moving the fingers away from each other to progressively separate the bilateral segments of the top seal. The bag may then be completely opened by separating the center portion of the top seal, by grasping and pulling apart the individual panels of the bag or by the sliding action of a forefinger.

It is to be understood that the exclusive use of the corrugated-type of heat seals in FIGS. 1 through 7 does not limit the invention solely thereto, as it would be in keeping with the spirit and scope of the present invention to use other types of seals such as thin, non-corrugated heat seals or separable seals accomplished by means other than heat sealing.

It should also be understood that a bag constructed in accordance with the present invention may be opened in an alternative manner. For example, and particularly with respect to a bag construction wherein the tubular pocket resides near the side margin of the bag, a forefinger may be inserted within the pocket and continue downward until it separates the portion of the top seal only below the pocket. A bag opened in this manner will allow the pocket to serve as a pour spout for a commodity such as a powder or a granular product. The bag, opened in such manner, may also be reclosed by inverting or inwardly folding the associating corner of the bag within a portion of the pocket.

What is claimed is:

1. A generally tubular package of flexible material having two opposing panels, a top margin comprising the top edge of said package, a bottom margin opposing said top margin, opposing side margins where said panels meet to define two opposing panel sides which extend the length of said package, and a commodity-confining compartment offset a predetermined distance from said top margin, defined by said panels, and situated between the top, bottom, and side margins of said package, said package being generally flat in the vicinity of said top margin and further comprising:

a top seal extending across the width of said package and located between said top edge and said commodity confining compartment, said top seal comprising separably joined, opposing portions of said panels;

a flat, generally tubular pocket having a closed perimeter portion defined by the configuration of said top seal wherein said top seal has a major portion which extends from one side margin across the width of said package to a location where a downwardly extending portion of said top seal progresses a substantial distance away from said top edge and extends to a location that is a substantial distance below said major portion in order to define a part of the closed perimeter portion of said tubular pocket which extends from a location adjacent said top edge to a location at the side of said commodity confining compartment, said top seal also progressing a further substantial distance both below said major portion and generally toward the other side margin of said package and to a location where said package defines a pocket side of adjoining portions of said panels, said adjoining portions completing. The closed perimeter portion of said tubular pocket in order to define a pocket interior surrounded by the flexible material of said package; and pocket access means associated with the flexible material located at said top edge and formed by said panels above said pocket interior for allowing an elongated object to pass said top edge for entry within said pocket interior and to extend to a position within said tubular pocket that is located at the side of said commodity-confining compartment, so that said elongated object may be moved toward said commodity-confining compartment and may act to progressively separate a substantial portion of said top seal for access to a confined commodity.

2. The package of claim 1, wherein said downwardly extending portion extends generally perpendicular of said top edge from a location near said top edge toward said bottom margin.

3. The package of claim 1, wherein said downwardly extending portion is non-perpendicular with respect to the top edge in its progression away from said top edge.

4. The package of claim 3, wherein said downwardly extending portion progresses generally away from said other side margin.

5. The package of claim 3, wherein said downwardly extending portion progresses generally toward said other side margin.

6. The package of claim 1, wherein said tubular pocket is located adjacent said other side margin.

7. The package of claim 1, wherein said tubular pocket is located substantially mid-position along the width of said package.

8. The package of claim 1, wherein said tubular pocket is located adjacent one of said side margins and said package has a midline seam comprising sealingly joined edge portions of said flexible material folded against a panel of the bag toward said tubular pocket.

9. The package of claim 1, wherein said pocket access means comprises a pocket mouth in open communication with the interior of said tubular pocket.

10. The package of claim 1, wherein said pocket access means comprises a substantially thin, readily-separable seal of joined portions of said flexible material located above said pocket interior.

11. The package of claim 1, wherein said top seal is spaced a predetermined distance from said top edge whereby said tubular pocket is offset a predetermined distance from said top edge.

12. An easy-opening provision defined by a package of predetermined width and length constructed from a tubular arrangement of flexible packaging material, said package having two opposing panels which collectively define a commodity-confining compartment, a top margin comprising the top edge of said package, opposing side margins where said panels meet to define two opposing panel sides which extend the length of said package, and a separable top seal extending across the width of said package and located between said top edge and said commodity-confining compartment, said top seal comprising separably joined, opposing portions of said panels, the opening provision comprising:

a generally flat, tubular pocket having a closed perimeter portion defined by the configuration of said top seal wherein said top seal has a major portion that progresses from one side margin across the width of said package toward the other side margin and, at a location along the width of said package, progresses a substantial distance away from said top edge to a location that is a substantial distance below said major portion, with a substantial further progression both below said major portion and toward the other side margin of said package defining a pocket bottom and to a location where said package defines a pocket side of adjoining portions of said panels the adjoining portions completing the closed perimeter portion of said tubular pocket in order to define a pocket interior surrounded by said packaging material; and pocket access means associated with the packaging material located at said top edge and formed by said panels above said pocket interior for allowing an elongated object to pass from said top edge toward said pocket bottom for entry within said pocket so that an end of said elongated object may be placed at the side of said commodity-confining compartment and may be moved toward said commodity-confining compartment in order to progressively separate a substantial portion of said top seal and open said package for access to a confined commodity.

13. The easy-opening provision of claim 12, wherein said tubular pocket is positioned adjacent a side margin of said package.

14. The easy-opening provision of claim 12, wherein said tubular pocket is located mid-position along the width of said package.

15. The easy-opening provision of claim 12, wherein said pocket access means comprises a pocket mouth in open communication with said pocket interior.

16. The easy-opening provision of claim 12, wherein said pocket access means comprises a substantially thin, readily-separable seal of joined packaging material located above said pocket interior at said top edge.

17. In a package of flexible packaging material having opposing top and bottom edges and a vertical seam of sealingly joined packaging material which extends the length of said package in order to define a generally tubular package having a front panel and an opposing rear panel defined between two opposing side margins which extend the length of said package, and whereby a separable top seal adjacent said top edge and an opposing bottom seal adjacent said bottom edge comprise sealingly joined, opposing portions of said front and rear panels which extend across the width of said package and which enclose a commodity within a commodity-confining compartment located between said front and rear panels, the improvement comprising:

said top seal having a configuration in its progression across the width of said package wherein a major portion of said top seal progresses a substantial distance from one side margin toward the other side margin and, at a location along the width of said package, forms a generally flat, tubular pocket having a closed perimeter portion by progressing both a substantial distance away from said top edge in the direction of said bottom seal and a substantial distance below said major portion, and also by progressing below said major portion a substantial distance further toward said other side margin defining a pocket bottom to a location where said package defines a pocket side of adjoining portions of said panels which completes the closed perimeter portion of said tubular pocket in order to define a pocket interior surrounded by packaging material and located below a pocket access means associated with the packaging material for allowing entry within said pocket interior and located at said top edge.

whereby an elongated object may be positioned within said tubular pocket through said pocket access means and an end of said elongated object may be located at the side of said commodity-confining compartment, so that said elongated object may be moved in the direction of a side margin of said package and may separate a portion of said top seal in order to enter said commodity-confining compartment and progressively separate a substantial portion of said top seal.

18. The package of claim 17, wherein said pocket and said pocket access means are located to one side of said vertical seam.

19. The package of claim 18, wherein said pocket access means is in open communication with said pocket interior.

20. The package of claim 18, wherein said pocket access means comprises a thin, readily separable seal means defined by said packaging material at said top edge.

* * * * *

UNITED STATES PATENT AND TRADEMARK OFFICE

CERTIFICATE OF CORRECTION

PATENT NO. : 4,964,515

DATED : Oct. 23, 1990

INVENTOR(S) : Eugene L. Heyden

It is certified that error appears in the above-identified patent and that said Letters Patent is hereby corrected as shown below:

Col. 3, line 31, "non-corrigated" should be --non-corrugated--.
line 56, delete ";".
Col. 5, line 67, delete ";".
Col. 7, line 43, delete "."
line 43, "The" should be --the--.
line 60, "perpendicular" should be --perpendicularly--.
Col. 8, line 53, after "panels" place a coma.
Col. 10, line 5, after "bottom" insert --and--.
Col. 10, line 13, "." should be --,--.

Signed and Sealed this

Seventh Day of April, 1992

*Attest:*

HARRY F. MANBECK, JR.

*Attesting Officer*

*Commissioner of Patents and Trademarks*